US008349464B2

(12) United States Patent
Wicher et al.

(10) Patent No.: US 8,349,464 B2
(45) **Date of Patent: *Jan. 8, 2013**

(54) PRE-IMPREGNATED PRODUCT

(75) Inventors: Martina Wicher, Bissendorf (DE); Mirko Standke, Leipzig (DE)

(73) Assignee: Schoeller Technocell GmbH & Co. KG, Osnabrück (DE)

( * ) Notice: Subject to any disclaimer, the term of this patent is extended or adjusted under 35 U.S.C. 154(b) by 343 days.

This patent is subject to a terminal disclaimer.

(21) Appl. No.: 12/666,575

(22) PCT Filed: Jun. 20, 2008

(86) PCT No.: PCT/EP2008/057870

§ 371 (c)(1), (2), (4) Date: Jan. 29, 2010

(87) PCT Pub. No.: WO2009/000769

PCT Pub. Date: Dec. 31, 2008

(65) Prior Publication Data

US 2010/0183890 A1 Jul. 22, 2010

(30) Foreign Application Priority Data

Jun. 28, 2007 (DE) ..... 10 2007 030 102

(51) Int. Cl.

| | |
|---|---|
| ***B32B 27/10*** | (2006.01) |
| ***B32B 27/30*** | (2006.01) |
| ***B32B 23/04*** | (2006.01) |
| ***B32B 21/06*** | (2006.01) |
| ***B32B 29/00*** | (2006.01) |

(52) U.S. Cl. ..... 428/514; 428/532; 428/533; 428/534; 428/536; 428/537.5

(58) Field of Classification Search ..... None
See application file for complete search history.

(56) References Cited

FOREIGN PATENT DOCUMENTS

| | | |
|---|---|---|
| DE | 19728250 | 1/1999 |
| EP | 0739435 | 12/1993 |
| EP | 0648248 | 4/1995 |
| EP | 0739435 | 10/1996 |
| EP | 0806522 | 11/1997 |
| EP | 0648248 | 11/1998 |
| EP | 1176255 | 1/2002 |
| WO | WO 01/11139 | 2/2001 |
| WO | WO 2007/000420 | 1/2007 |

OTHER PUBLICATIONS

International Search Report dated Nov. 3, 2008 from PCT/EP2008/057870.

*Primary Examiner* — Sheeba Ahmed
(74) *Attorney, Agent, or Firm* — Honigman Miller Schwartz and Cohn LLP; Thomas W. Wootton; Jonathan P. O'Brien

(57) ABSTRACT

A prepreg can be obtained by impregnating a decorative base paper with an impregnating resin solution which contains at least one polymer latex and at least one modified starch with a specific molecular weight distribution.

11 Claims, No Drawings

PRE-IMPREGNATED PRODUCT

This application is the U.S. National phase of PCT Application No. PCT/EP2008/057870 filed, Jun. 20, 2008, which claims the priority of German Application No. DE 10 2007 030 102.4, filed Jun. 28, 2007. Both of these documents are incorporated herein in their entirety.

The invention relates to prepregs and impregnated decorative papers or decorative coating materials obtainable therefrom.

Decorative coating materials, so-called decorative papers or decorative foils, are preferably used to coat surfaces in furniture manufacturing and in interior fitting, in particular in laminate flooring. The term "decorative paper/decorative foil" means synthetic resin-impregnated or synthetic resin-impregnated and surface-treated, printed or unprinted papers. Decorative papers/decorative foils are bonded or glued to a support board.

A distinction, which depends on the type of impregnation procedure, is drawn between decorative papers/decorative foils with a completely impregnated paper core and so-called prepregs whereby the paper of a prepreg is only partially impregnated online in the paper machine or offline. None of the currently known prepregs, which contain formaldehyde-containing duroplastic resins or formaldehyde-poor acrylate-type binding agents, fulfils all of the requirements placed on them, such as good printability, high internal bond, good bondability (gluability) and good coating properties varnishability.

Urea sizes or polyvinyl acetate (PVAC) sizes are usually used to adhere the decorative foils onto wood material such as chipboard or MDF board. The bonding of the decorative foils is not always assured.

High pressure laminates are laminates which are formed by pressing together several impregnated papers stacked on top of one another. In general, such high pressure laminates are constituted by an uppermost transparent overlay which produces surface resistance, a resin-impregnated decorative paper and one or more phenolic resin-coated kraft papers. The underlay is, for example, hardboard or wood chipboard, or even plywood.

In case of low pressure laminates, the decorative paper impregnated with synthetic resin is pressed directly onto an underlay, for example plywood, using low pressure.

The decorative paper used in the coating materials mentioned above is white or coloured, with or without additional printing.

So-called decorative base papers acting as raw materials must satisfy specific technical requirements as regards properties in use. These include high opacity to improve covering of the underlay, uniform formation and grammage of the sheet for uniform resin uptake, high light-fastness, high purity and uniformity of colour for good reproducibility of the pattern to be printed, high wet strength for a smooth impregnation procedure, an appropriate absorbency in order to obtain the required degree of resin saturation, and dry strength, which is important in rewinding operations in the paper machine and for printing in the printing machine. Furthermore, the internal bond is of particular importance as it is a measure of how good the decorative base paper can be processed. Thus, the bonded decorative paper/decorative foils must not fray during processing steps such as sawing or drilling.

In order to produce a decorative surface, decorative base papers are printed. So-called rotogravure printing processes are primarily employed, wherein the printing image is transferred onto the paper by means of several gravure rolls. The individual dots to be printed should be transferred completely and with maximum intensity onto the paper surface. However, in decor gravure, only a small proportion of the raster dots present on the gravure roll are transferred onto the paper surface. So-called missing dots occur. Frequently, the printing ink penetrates too deeply into the paper structure, whereupon the intensity of the colour is reduced. Prerequisites for a good printed image with few missing dots and a high colour intensity are as smooth and homogeneous a surface topography as possible, and balanced colour uptake behaviour for the paper surface.

For this reason, base papers are usually smoothed using so-called soft calenders, occasionally also termed Janus calenders. This treatment can result in the paper surface being squeezed, thereby compressing it, which has an adverse effect on the resin take-up ability.

The properties mentioned above are primarily influenced by the impregnation of the decorative base paper, i.e. the type of impregnating agent employed.

The impregnating resin solutions in normal use for the impregnation of decorative base papers are resins based on urea, melamine or phenolic resins, contain formaldehyde and result in brittle products with poor tearing resistance and printability.

Recently, it has become increasingly important to take care that the impregnating resin solutions used to impregnate decorative base papers are free from environmentally damaging substances, and in particular are free from formaldehyde.

DE 197 28 250 A1 discloses the use of formaldehyde-free resins based on a styrene/acrylic acid ester copolymer for the production of yellowing-free prepregs. The disadvantage with that material is that it results in a product with a poor internal bond.

Formaldehyde-free impregnating resin solutions for the impregnation of decorative base papers are also described in EP 0 648 248 A1 and EP 0 739 435 A1. They preferably consist of a styrene-acrylic acid ester copolymer and polyvinyl alcohol. However, paper impregnated with such an impregnating resin solution is still in need of improvement because of its internal bond.

WO 01/11139 discloses a formaldehyde-free composition consisting of a binding agent, an aqueous polymer dispersion and glyoxal, which means that decorative papers with a high internal bond can be produced. However, paper impregnated with such a composition cannot readily be laminated.

Thus, the object of the invention is to provide a formaldehyde-free prepreg which does not have the disadvantages mentioned above and in particular enjoys good printability and a high internal bond.

This object is achieved by means of a prepreg which can be obtained by impregnating a base paper with an impregnating resin solution which contains at least one polymer latex and at least one modified starch, which has a molecular weight distribution, expressed as a polydispersity index, Mw/Mn, of at least 6. Preferred starches have a polydispersity index of 6 to 23.

In a particular embodiment of the invention, the impregnating resin solution contains at least one polymer latex and at least one modified starch which preferably has the following molecular weight distribution for the starch molecules:

- at most 6% by weight of molecules with a molecular weight of 0 to 1 000 g/mol;
- 5 to 20% by weight of molecules with a molecular weight of 1 000 to 5 000 g/mol;
- 20 to 40% by weight of molecules with a molecular weight of 5 000 to 25 000 g/mol;

20 to 45% by weight of molecules with a molecular weight of 25 000 to 200 000 g/mol;

5 to 22% by weight of molecules with a molecular weight of 200 000 to 1 000 000 g/mol;

0.5 to 5% by weight of molecules with a molecular weight of more than 1 000 000 g/mol.

The polydispersity index is normally taken to be the ratio between the mass average and number average molecular masses, Mw/Mn. It provides information regarding the width of the molecular weight distribution curve.

The molecular weight distribution of the modified starches was determined with the aid of gel permeation chromatography (GPC) in the normal manner by the starch manufacturer.

The GPC analysis was carried out using a chromatograph with a Shodex KS column. The elution medium was 0.05 M NaOH with a flow rate of 1 ml/min. Calibration was carried out using Pullulan standards with known molecular weights.

All of the modified starches used in the context of the invention are commercially available. In particular, they are thermally and oxidatively degraded corn and potato starches.

The term "prepreg" as used in the context of the invention means papers which are partially impregnated with resin. The quantity of impregnating resin is preferably 10 to 35% by weight, but in particular 12 to 30% by weight, with respect to the basis weight of the decorative base paper.

It has been shown that the impregnating resin solution in accordance with the invention is particularly suitable since it not only brings about an improvement in the internal bond of papers impregnated thereby, but it also provides comparably good or even better results than those obtainable in the prior art as regards other properties such as printability, varnish hold-out or yellowing. Furthermore, the problems usually encountered on laminating (bonding or gluing with the underlay) impregnated papers when using hydrophilic binding agents do not arise. This means that the impregnating resin solution in accordance with the invention allows prepregs with good lamination properties to be produced. A further advantage is that the prepreg can be produced economically at high machine speeds.

The polymer latex can preferably be a styrene copolymer such as a styrene-acrylic acid ester copolymer, a styrene-vinyl acetate copolymer, a styrene-butadiene or a styrene-maleic acid copolymer. However, blends of these copolymers may also be used. Particularly preferred polymers are those which have high self-cross-linking properties. However, non self-cross-linking polymers are also suitable.

In a particular embodiment of the invention, the impregnating resin solution employed for the production of the prepreg in accordance with the invention contains an ethyl-free styrene-acrylic acid ester.

The quantitative starch/polymer latex ratio in the impregnating resin solution is preferably 80/20 to 20/80, but preferably, the quantitative ratio is 45/55 to 65/35 and in particular 50/50 to 60/40, each with respect to the mass of the impregnating resin (bone dry=b.d.).

In a further embodiment of the invention, the impregnating resin solution contains pigments and/or fillers. The quantity of pigments and/or fillers can be from 1 to 30% by weight, in particular 2 to 20% by weight. The quantities given are with respect to the weight of binding agent (b.d.). The term "binding agent" means the mixture containing the polymer latex and the modified starch.

The impregnating resin solution used to produce the prepreg in accordance with the invention has a total solids content, with respect to the dry weight, of 9 to 40% by weight, preferably 20 to 35% by weight and particularly preferably 26 to 30% by weight.

When producing the impregnating resin solution, initially the starch is prepared; it is either cold, i.e. dissolved in water at room temperature to at most 60° C., or it is boiled at approximately 120 to 145° C. In this respect, an approximately 40 to 45% suspension is produced with a pH of approximately 5 to 6. In the next step, an approximately 50% latex dispersion is added at a pH of 5 to 10, taking the desired solids content and the quantitative starch/latex ratio into account. In a further step, a pigment or filler can be added.

The decorative base papers to be impregnated are those which have not undergone internal sizing or surface sizing. They essentially consist of pulp, pigments and fillers and the usual additives. The usual additives may be wet strength agents, retention agents and fixing agents. Decorative base papers differ from normal papers in the much higher proportion of filler or pigment content and the lack of internal sizing or surface sizing which is usual in paper.

The base paper to be impregnated in accordance with the invention may contain a high proportion of a pigment or a filler. The proportion of filler in the base paper can be up to 55% by weight, in particular 8 to 45% by weight, with respect to the basis weight. Examples of suitable pigments and fillers are titanium dioxide, talc, zinc sulphide, kaolin, aluminium oxide, calcium carbonate, corundum, aluminium and magnesium silicates or mixtures thereof.

The pulps used for the manufacture of the base papers may be softwood pulp (long fibre pulp) and/or hardwood pulp (short fibre pulp). In addition, cotton fibres and mixtures thereof with the pulp types mentioned above may be used. A mixture of softwood/hardwood pulps in a ratio of 10:90 to 90:10, in particular 20:80 to 80:20, for example, is particularly preferred. However, using 100% by weight hardwood pulp has also proved to be advantageous. The quantities given are with respect to the mass of the pulp (b.d).

Preferably, the pulp mixture can contain a proportion of cationically modified pulp fibres of at least 5% by weight, with respect to the weight of the pulp mixture. A proportion of 10 to 50% by weight, in particular 10 to 20% by weight of cationically modified pulp in the pulp mixture has proved to be particularly preferable. The pulp fibres can be cationically modified by reacting the fibres with an epichlorohydrin resin and a tertiary amine or by reaction with quaternary ammonium chlorides such as chlorohydroxypropyl trimethylammonium chloride or glycidyl trimethylammonium chloride. Cationically modified pulps and their manufacture are, for example, known from DAS PAPIER, volume 12 (1980), pp 575-579.

The base papers can be manufactured on a Fourdrinier paper machine or a Yankee paper machine. To this end, the pulp mixture with a stock consistency of 2 to 5% by weight can be beaten to a degree of beating of 10 to 45° SR. The fillers, such as titanium dioxide and talc, along with wet strength agent, can be placed in a mixing vat and mixed well with the pulp mixture. The thick matter (high consistency) obtained thereby can be thinned to a stock consistency of approximately 1% and if necessary, further auxiliary materials such as retention agents, defoaming agents, aluminium sulphate and other already cited auxiliary substances can be mixed in. This thin matter (low consistency) is guided over the headbox of the paper machine onto the wire section. A fibrous web is formed and after dewatering, the base paper is obtained which is then dried. The basis weights of the papers which are produced may be 15 to 300 g/m$^2$. However, base papers with a basis weight of 40 to 100 g/m$^2$ are particularly appropriate.

The impregnating resin solution to be used in accordance with the invention can be applied in the paper machine or offline by spraying, immersion, roll application or coating (doctor blade). Particularly preferably, application is by size press coating or film press coating.

The impregnated papers are dried in the usual manner using IR or drum dryers in a temperature range of 120 to 180° C. to a residual moisture content of 2 to 6%. After drying, the thus impregnated papers (prepregs) can further be printed and coated and then be laminated onto various substrates, for example chipboard or fibreboard, using the usual processes.

The examples below serve to further illustrate the invention. Data given as a percentage are with respect to the weight of the pulp, unless otherwise indicated. The quantitative ratio means the ratio of the masses, or the weight ratio.

EXAMPLES

Example 1

A suspension of pulp was produced in which a pulp mixture of 80% by weight eucalyptus pulp and 20% by weight pine kraft pulp with a stock consistency of 5% was beaten to a degree of beating of 33° SR (Schopper-Riegler). Next, 1.8% by weight of epichlorohydrin resin was added as a wet strength agent. The pH of this pulp suspension was adjusted to 6.5 using aluminium sulphate. Then the pulp suspension was supplemented with a mixture of 30% by weight titanium dioxide and 5% by weight talc, 0.11% by weight of a retention agent and 0.03% by weight of a defoaming agent and a decorative base paper with a basis weight of approximately 50 g/m$^2$ and an ash content of approximately 23% by weight was prepared. The weights given are with respect to the weight of the pulp (b.d.).

This base paper was impregnated on both sides in a size press with an aqueous resin solution of approximately 25% by weight solid content, containing modified C-film 07324 starch (starch I, Table 1) and n-butylacrylate-styrene copolymer (Acronal® S 305 D) in a quantitative ratio of 80:20. To this end, a 45% starch solution was initially prepared and diluted to a concentration of 25% by weight with water. Next, the corresponding quantity of 50% by weight aqueous polymer dispersion was added and the polymer solution obtained was diluted to a solids content of 25% by weight with water.

The impregnated paper was then dried at a temperature of approximately 120° C. to a residual moisture content of 2.5%. The coating weight following drying was 10 g/m$^2$.

Example 2

The base paper from Example 1 was impregnated, using a size press, with an aqueous resin solution containing modified starch I and n-butylacrylate-styrene copolymer (Acronal® S 305 D) in a quantitative ratio of 60:40, with three different coating weights. The solids content of the resin solution was 26% by weight.

The impregnated papers were then dried at a temperature of approximately 120° C. to a residual moisture content of 2.5%. The coating weights following drying were 7 g/m$^2$ (Example 2A), 10 g/m$^2$ (Example 2B) and 14 g/m$^2$ (Example 2C).

Example 3

The base paper from Example 1 was impregnated, using a size press, with an aqueous resin solution with a solids content of 27% by weight which contained modified starch I and n-butylacrylate-styrene copolymer (Acronal® S 305 D) in a quantitative ratio of 50:50.

The impregnated paper was then dried at a temperature of approximately 120° C. to a residual moisture content of 2.5%. The coating weight following drying was 10 g/m$^2$.

Example 4

The base paper from Example 1 was impregnated, using a size press, with an aqueous resin solution with a solids content of 25% by weight which contained modified starch I and n-butylacrylate-styrene copolymer (Acronal® S 305 D) in a quantitative ratio of 20:80.

The impregnated paper was then dried at a temperature of approximately 120° C. to a residual moisture content of 2.5%. The coating weight following drying was 10 g/m$^2$.

Example 5

The base paper from Example 1 was impregnated, using a size press, with an aqueous resin solution with a solids content of 25% by weight which contained the modified starch C-film 07311 (starch II, see Table 1) and n-butylacrylate-styrene copolymer (Acronal® S 305 D) in a quantitative ratio of 60:40.

The impregnated paper was then dried at a temperature of approximately 120° C. to a residual moisture content of 2.5%. The coating weight following drying was 10 g/m$^2$.

Example 6

The base paper from Example 1 was impregnated, using a size press, with an aqueous resin solution with a solids content of 25% by weight which contained the modified starch C-film 07302 (starch III, see Table 1) and n-butylacrylate-styrene copolymer (Acronal® S 305 D) in a quantitative ratio of 60:40.

The impregnated paper was then dried at a temperature of approximately 120° C. to a residual moisture content of 2.5%. The coating weight following drying was 10 g/m$^2$.

Example 7

The base paper from Example 1 was impregnated, using a size press, with an aqueous resin solution containing a modified starch I and a hydrophobized styrene-butylacrylate copolymer (Cartacoat® B 641) in a quantitative ratio of 60:40. The solids content of the resin solution was 26% by weight. The impregnated paper was then dried at a temperature of approximately 120° C. to a residual moisture content of 2.5%. The coating weight following drying was 10 g/m$^2$.

Example 8

The base paper from Example 1 was impregnated, using a size press, with an aqueous resin solution containing modified starch I and a styrene-n-butylacrylate copolymer (Acronal® S 305 D) in a quantitative ratio of 60:40 as well as titanium dioxide in a quantity of 15% by weight (with respect to the quantity of binding agent (b.d.)). The solids content of the resin solution was 28% by weight. The impregnated paper was then dried at a temperature of approximately 120° C. to a residual moisture content of 2.5%. The coating weight following drying was 10 g/m$^2$.

Comparative Example V1

The base paper from Example 1 was impregnated, using a size press, with an aqueous resin solution containing a dextrin (see Table 1) and a n-butylacrylate-styrene copolymer (Acronal® S 305 D) in a quantitative ratio of 60:40. The solids content of the resin solution was approximately 26% by weight. The impregnated paper was then dried at a temperature of approximately 120° C. to a residual moisture content of 2.5%. The coating weight following drying was 10 g/m$^2$.

Comparative Example V2

The base paper from Example 1 was impregnated, using a size press, with an aqueous resin solution containing modified C-film 07380 starch (starch IV, see Table 1) and styrene-n-butylacrylate copolymer (Acronal® S 305 D) in a quantitative ratio of 60:40. The solids content of the resin solution was approximately 26% by weight.

The impregnated paper was then dried at a temperature of approximately 120° C. to a residual moisture content of 2.5%. The coating weight following drying was 10 g/m$^2$.

Comparative Example V3

The base paper from Example 1 was impregnated, using a size press, with an aqueous resin solution containing polyvinyl alcohol (Mowiol® 4-98) and a styrene-n-butylacrylate copolymer (Acronal® S 305 D) in a quantitative ratio of 20:80. The solids content of the resin solution was approximately 27% by weight.

The impregnated paper was then dried at a temperature of approximately 120° C. to a residual moisture content of 2.5%. The coating weight following drying was 10 g/m$^2$.

Table 2 below shows the results of tests on the papers treated in accordance with the invention compared with the prior art. The following properties were tested:

Tensile Strength (as Measure of Internal Bond)

The tensile strength perpendicular to the paper surface was determined in accordance with a routine method for decorative papers, TGL 25290/11 (Institut für Technologie der EPH, Zürich). To this end, initially test specimens having a diameter of 20 mm were punched out of the prepreg to be tested and were placed individually between two cylinder surfaces and bonded and cured to these surfaces. The specimens which were so formed were clamped in the holder perpendicular to the plane of the sheet and an increasing load was applied until rupture occurred. The tensile strength was calculated as follows:

$$\sigma\approx 1B=F_{max}/A$$

σ≈1B—tensile force perpendicular to plane of sheet in MPa (N/mm$^2$);

$F_{max}$—force at rupture of specimen, N;

A—specimen surface area, mm$^2$ (314 mm$^2$ when d=20 mm).

Printability

Visual evaluation was carried out using a reference catalogue. Grades: 1 (very good) to 6 (very bad).

Varnish Hold-Out (Visual Evaluation)

The evaluation was carried out by comparison with the prior art (prepreg from Arjo Wiggins, comparative Example 3). To this end, the prepreg specimens were coated with an acid-curing lacquer (acid-curing primer/water resistant, varnish with built-in acid hardener), which was routinely used for this purpose, in an amount of 12 g/m$^2$. The varnished surfaces were then evaluated under oblique light and compared with each other.

Yellowing (Δb Value Determination)

The yellowing index was determined in accordance with DIN 6167. It provides the change in the yellowing of a specimen under the influence of temperature over a specific time period. It is the difference in the so-called yellowness Δb of the treated and untreated specimen.

The b values were measured using a SF 600 spectrophotometer (Datacolor) at D65 10°.

Table 2 shows that the prepregs in accordance with the invention exhibit a higher strength in z-direction and better printability. The yellowing behaviour, in particular at higher temperatures, is also improved in the prepregs in accordance with the invention. The varnish holdout is better than or comparable with the usual prepregs.

TABLE 1

| Modified starches | | | | | |
|---|---|---|---|---|---|
| MW distribution g/mol | Starch I | Starch II | Starch III | Starch IV | Dextrin (Licopol from Südstärke) |
| 0-1 000 | 3.90 | 4.42 | 1.83 | 12.20 | 8.54 |
| 1 000-5 000 | 14.54 | 16.36 | 7.63 | 34.41 | 33.88 |
| 5 000-25 000 | 36.56 | 28.68 | 22.59 | 47.50 | 48.98 |
| 25 000-200 000 | 38.85 | 35.54 | 42.74 | 5.89 | 8.61 |
| 200 000-1 000 000 | 5.60 | 12.5 | 20.71 | 0.00 | 0.00 |
| 1 000 000-5 000 000 | 0.56 | 2.48 | 4.50 | 0.00 | 0.00 |
| >5 000 000 | 0.00 | 0.02 | 0.00 | 0.00 | 0.00 |
| Polydispersity index | 11.2 | 22.3 | 19.0 | 4.2 | 3.4 |

TABLE 2

| Test results | | | | | | | | | | | | | |
|---|---|---|---|---|---|---|---|---|---|---|---|---|---|
| | Examples | | | | | | | | | | | | |
| Test | 1 | 2A | 2B | 2C | 3 | 4 | 5 | 6 | 7 | 8 | V1 | V2 | V3 |
| Tensile strength | 8 | 8 | 8 | 8 | 8 | 8 | 8 | 8 | 8.5 | 7.5 | 7 | 7 | 7 |
| Printability | 2 | 2 | 2 | 2 | 2 | 2 | 2 | 2 | 2 | 1.5 | 3 | 2 | 4 |
| Varnish hold-out | better | better | better | better | better | good | better | better | better | better | good | good | good |

TABLE 2-continued

| Test results | | | | | | | | | | | | | |
|---|---|---|---|---|---|---|---|---|---|---|---|---|---|
| | Examples | | | | | | | | | | | | |
| Test | 1 | 2A | 2B | 2C | 3 | 4 | 5 | 6 | 7 | 8 | V1 | V2 | V3 |
| Yellowing Δb 140°-190° C. | 1.3 | 1.3 | 1.3 | 1.3 | 1.3 | 1.3 | 1.5 | 1.5 | 1.2 | 1.5 | 2.0 | 1.7 | 1.5 |
| Yellowing Δb 140°-210° C. | 3.0 | 3.0 | 3.0 | 3.0 | 3.0 | 3.0 | 3.2 | 3.2 | 2.7 | 2.9 | 4.0 | 3.5 | 3.6 |

We claim:

1. A prepreg obtained by impregnating a decorative base paper with an impregnating resin solution, wherein the impregnating resin solution comprises at least one polymer latex and at least one modified starch with a specific molecular weight distribution, wherein the molecular weight of the starch molecules is:

(a) at most 6% by weight of molecules with a molecular weight of 0 to 1,000 g/mol;

(b) 5% to 20% by weight of molecules with a molecular weight of 1,000 to 5,000 g/mol;

(c) 20% to 40% by weight of molecules with a molecular weight of 5,000 to 25,000 g/mol;

(d) 20% to 45% by weight of molecules with a molecular weight of 25,000 to 200,000 g/mol;

(e) 5% to 22% by weight of molecules with a molecular weight of 200,000 to 1,000,000 g/mol;

(f) 0.5% to 5% by weight of molecules with a molecular weight of more than 1,000,000 g/mol.

2. The prepreg of claim 1, wherein the polymer latex is a styrene-(meth)acrylic acid ester copolymer.

3. The prepreg of claim 2, wherein the polymer latex is a styrene-butyl acrylate.

4. The prepreg of claim 3, wherein the ratio of quantitative starch to polymer latex is in the range of 20:80 to 80:20, with respect to the mass of the impregnating resin (b.d.).

5. The prepreg of claim 4, wherein the ratio is in the range of 45:55 to 65:35 with respect to the mass of impregnating resin (b.d.).

6. The prepreg of claim 5, wherein the impregnating resin solution contains 1 to 30% by weight of a pigment and/or a filler, with respect to the mass of binding agent (b.d.).

7. The prepreg of claim 6, wherein the pigment can be titanium dioxide, kaolin, bentonite and/or calcium carbonate.

8. The prepreg of claim 7, wherein the impregnating resin solution has a solids content of 9 to 40% by weight.

9. The prepreg of claim 8, wherein the quantity of impregnating resin is 10 to 35% by weight of the basis weight of the decorative base paper.

10. A decorative paper or decorative coating material obtained from the prepreg of claim 9.

11. A decorative paper or decorative coating material obtained from the prepreg of claim 1.

* * * * *